US006059711A

United States Patent [19]

Wang

[11] Patent Number: 6,059,711

[45] Date of Patent: May 9, 2000

[54] DEVICE FOR TEARING AND FOLDING PAPER IN SERIES

[75] Inventor: Chwan-Jon Wang, Taichung, Taiwan

[73] Assignee: Ecom Information Co., Ltd., Taichung, Taiwan

[21] Appl. No.: 09/184,086

[22] Filed: Nov. 2, 1998

[51] Int. Cl.[7] ..... B31B 1/14

[52] U.S. Cl. ..... 493/360; 493/421; 493/444

[58] Field of Search ..... 493/360, 421, 493/444, 445, 443; 225/100

[56] References Cited

U.S. PATENT DOCUMENTS

| | | | |
|---|---|---|---|
| 3,822,878 | 7/1974 | Mantovani | 270/68 |
| 4,221,372 | 9/1980 | Foerster | 270/58 |
| 5,102,111 | 4/1992 | Reponty | 270/12 |
| 5,871,433 | 2/1999 | Lehmann et al. | 493/420 |

*Primary Examiner*—Peter Vo
*Assistant Examiner*—Sameh Tawfik
*Attorney, Agent, or Firm*—Browdy and Neimark

[57] ABSTRACT

A device is provided for tearing off a series of perforated paper sheets and folding the detached paper sheets. The device is composed of a frame, at least two paper feeding rollers, at least three paper folding rollers, a plurality of paper guiding plates, at least one paper confining element corresponding in location to the paper folding rollers, and a linking member consisting of a transmission belt, a paper feeding wheel and a paper folding wheel. The transmission belt is driven by a driving unit to actuate the paper feeding wheel and the paper folding wheel, which in turn actuate the paper feeding rollers and the paper folding rollers.

8 Claims, 8 Drawing Sheets

DEVICE FOR TEARING AND FOLDING PAPER IN SERIES

FIELD OF THE INVENTION

The present invention relates generally to a paper tearing and folding device, and more particularly to a device for tearing a series of perforated paper sheets and folding the detached paper sheets.

BACKGROUND OF THE INVENTION

The conventional method for processing a series of the computer printout sheets, such as tax paper, license paper, etc., involves the use of a paper tearing device and a paper folding device. The paper tearing device is used to tear the perforated computer printout sheets. The paper folding device is intended to fold the detached paper sheet in such a manner that the folded paper sheet can be put into an envelope with ease and speed.

Such conventional paper tearing device and paper folding device as described above are not cost-effective. In addition, it is difficult to synchronize the operations of the conventional paper tearing device and the conventional paper folding device, so as to enhance the overall efficiency of the paper processing method.

SUMMARY OF THE INVENTION

It is therefore the primary objective of the present invention to provide a device for tearing and folding paper in series. The device is relatively cost-effective.

It is another objective of the present invention to provide a device for tearing and folding paper sequentially. The device is relatively efficient.

It is still another objective of the present invention to provide a device for tearing and folding paper in series. The device is simple in construction and can be made economically.

In keeping with the principle of the present invention, the foregoing objectives of the present invention are attained by the device for tearing and folding paper in series. The device consists of a frame, two paper feeding rollers fastened pivotally with the frame, three paper folding rollers fastened pivotally with the frame, a plurality of paper guiding plates mounted on the frame, a paper restricting element mounted on the frame, a linking member consisting of a transmission belt, a paper feeding wheel and a paper folding wheel. The transmission belt is intended to impart motion from the paper feeding wheel and the paper folding wheel to the paper feeding rollers and the paper folding rollers. The paper feeding rollers are slower in rotational speed than the paper folding rollers. The device is provided with a driving unit for driving the transmission belt.

The foregoing objectives, features, functions and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
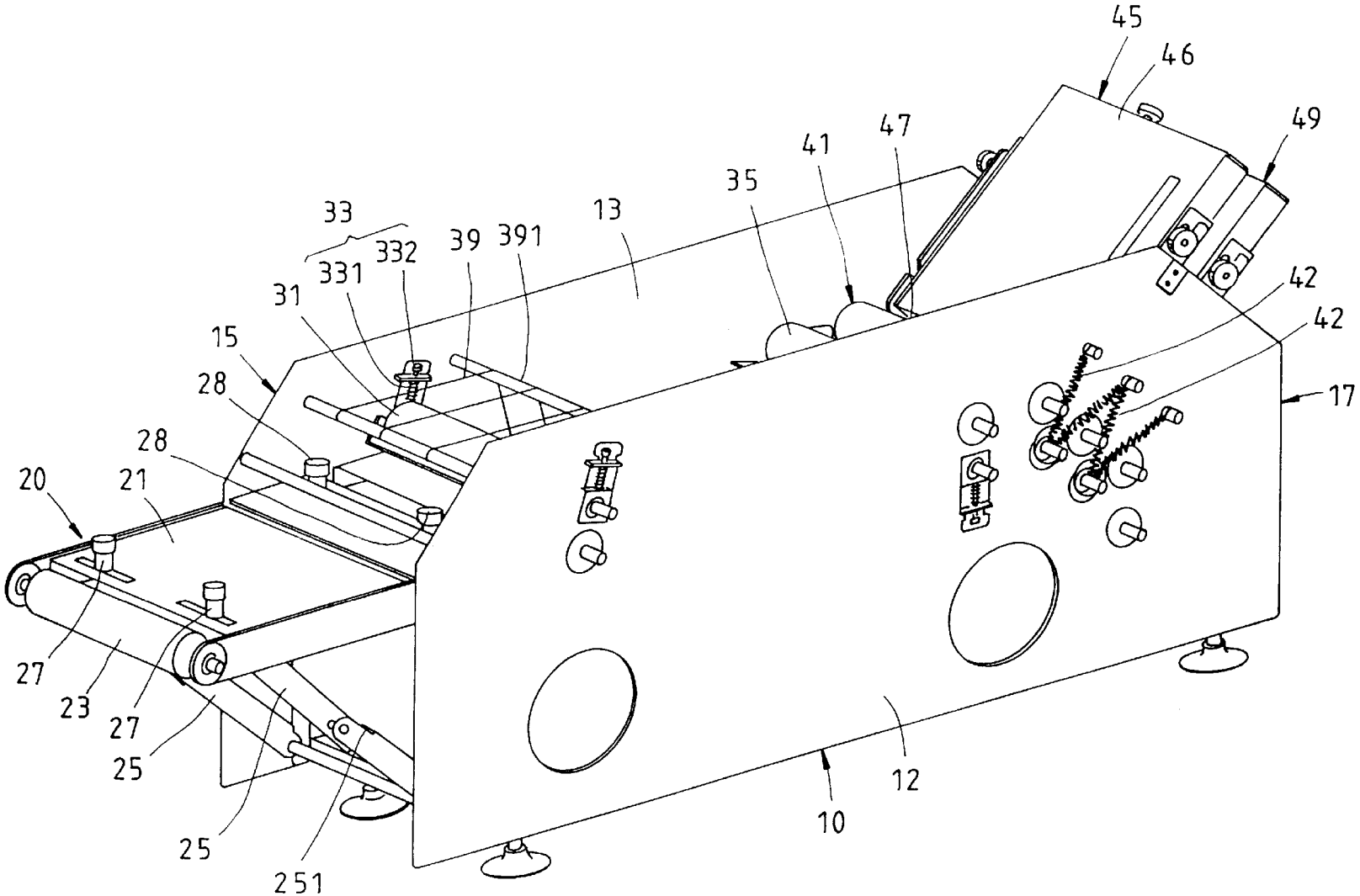
FIG. 1 shows a right elevational view of a preferred embodiment of the present invention.

As shown in FIGS. 1–4, a device embodied in the present invention is intended to tear a series of perforated paper 90 and fold the detached paper 90. The device of the present invention comprises the component parts, which are described hereinafter.

A frame 10 is provided with two support plates 12 and 13 which are located at both sides thereof.

A paper guiding member 20 is mounted at a paper feeding end 15. The paper guiding member 20 has a paper holding member 21 of a rectangular construction. The paper holding member 21 is fastened pivotally at both ends of the rear side thereof with two support plates 12 and 13 of the frame 10 such that the paper holding member 21 is capable of swiveling between a paper holding position and a folding position. A paper guiding roller 23 is fastened pivotally at both ends thereof with two ends of the front side of the paper holding member 21 for guiding the paper to travel smoothly. Two crank arms 25 are fastened respectively at both ends thereof with the frame 10 and the paper holding member 21 such that the two crank arms 25 can bend or stretch out straight. When the crank arms 25 stretch out straight, the paper holding member 21 is located at the paper holding position. Two pairs of paper guiding portions 27 and 28 are mounted respectively at the front end and the rear end of the paper holding member 21 such that the distance between the paper guiding portions 27 and 28 can be adjusted to suit the papers of various sizes and to correct the angle at which the paper is entered.

A pair of paper feeding rollers 31 and 32 are fastened pivotally with the two support plates 12 and 13 such that the paper feeding rollers 31 and 32 are pressed against each other, and that the paper feeding rollers 31 and 32 are located behind the paper guiding member 20, thereby enabling the paper to be guided by the paper guiding member 20 before the paper is held between the paper feeding rollers 31 and 32. The roller 31 is movably fastened at both ends thereof with the two support plates 12 and 13 in conjunction with a pressure adjustment mechanism 33 which is composed of an elastic element 331 and an adjustment member 332 for adjusting the elastic force of the elastic element 331. The roller 31 is thus elastically pressed against the roller 32. The pressure adjustment mechanism 33 is a prior art structure.

Two orienting rollers 35 and 36 are fastened pivotally at both ends thereof with the support plates 12 and 13 such that the two orienting rollers 35 and 36 are pressed against each other, and that the two orienting rollers 35 and 36 are located behind the paper feeding rollers 31 and 32. The orienting roller 36 is fastened with the two support plates 12 and 13 by means of the pressure adjustment mechanism 33 such that the orienting roller 35 is elastically pressed against by the orienting roller 36. A rod body 37 is fastened at both ends thereof with the support plates 12 and 13 and is located between the paper feeding rollers 31, 32 and the orienting rollers 35, 36, such that the rod body 37 is located under a straight line connecting the paper feeding rollers and the orienting rollers. The distance between the rod body 37 and the orienting rollers 35, 36 is equal to the length of paper to be torn off. A guide plate 371 is fastened at both ends thereof with the support plates 12 and 13 and located between the paper feeding rollers 31, 32 and the rod body 37 for guiding the paper to locate under the rod body 37. A paper holding portion 38 is made of a soft cloth and provided with a plurality of cross rods 381 which are fastened with the support plates 12 and 13. The paper holding portion 38 is run on the cross rods 381 such that the paper holding portion 38 is located under the paper feeding rollers 31 and 32. A position confining portion 39 is formed of a plurality of nylon threads and is run on the cross rods 391 such that the position confining portion 39 is located above the paper holding portion 38 to form a confining path located between the paper holding portion 38 and the position confining portion 39, thereby confining the paper to move under the rod body 37 and between the orienting rollers 35 and 36.

Five paper folding rollers 41 are fastened pivotally with the support plates 12 and 13 such that the paper folding rollers 41 are alternately pressed against one another and located behind the orienting rollers 35 and 36 at an interval. When the paper is passing through, the paper folding rollers 41 are held at the same time between the orienting rollers 35, 36 and the first and the second paper folding rollers 411, 412. The second and the fourth paper folding rollers 412 and 414, and the support plates 12, 13 are provided therebetween with two elastic elements 42 for forcing the second roller 412 to press elastically against the first and the third rollers 411 and 413. In the meantime, the third and the fifth rollers 413 and 415 are elastically pressed against by the fourth paper folding roller 414. Two paper guiding plates 43 are fastened with the support plates 12 and 13 and respectively located between the second and the fourth paper folding roller 412, 414, and between the fourth and the fifth paper folding rollers 414, 415, so as to guide the moving direction of the paper. Two paper confining elements 45 and 49 are provided with a housing 46 which has an opening 47 and a position confining member 48 capable of adjusting the length of entry of the paper. The paper confining elements 45 and 49 are respectively located between the first and the third rollers 411 and 413, and between the third and the fifth rollers 413 and 415. The paper confining elements 45 and 49 form a predetermined angle with the tangent line of these rollers which are pressed against one another.

A driving unit 50 of the present invention is a motor, which is mounted in the frame 10 and provided with a rotary shaft (not shown in the drawing).

Figure 2:
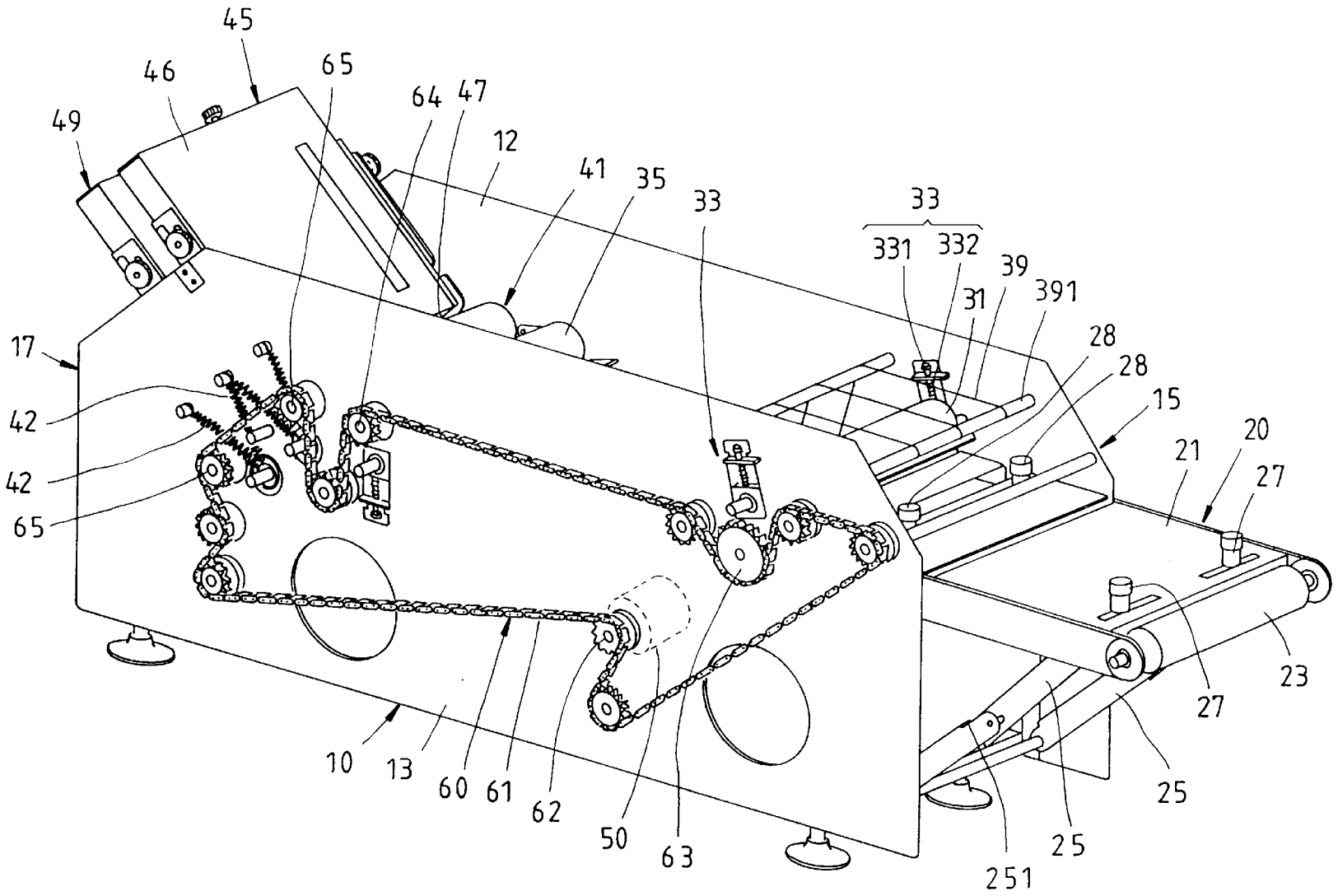
FIG. 2 shows a left elevational view of the preferred embodiment of the present invention.

A linking member 60 has a transmission belt 61, a driving wheel 62, a paper feeding wheel 63, an orienting wheel 64, and two paper folding wheels 65. The transmission belt 61 of the present invention is a chain, whereas the wheels 62, 63 and 64 of the present invention are gears, which are driven by a drive shaft (not shown in the drawing) of the driving unit 50. The paper feeding rollers 33, the orienting rollers 35, and the first and the fifth paper folding rollers are mounted in the same side of the support plate 13, as shown in FIG. 2, such that they are engaged with the transmission belt 61, and that they are actuated by the transmission belt 61. The paper feeding wheel 63 is greater in diameter than the orienting wheel 64 which rotates faster than the paper feeding wheel 63. The paper folding wheels 65 are corresponding in diameter to the orienting wheel 64. The orienting rollers 35 and 36 are corresponding in diameter and rotational speed to the paper folding rollers 41.

Figure 3:
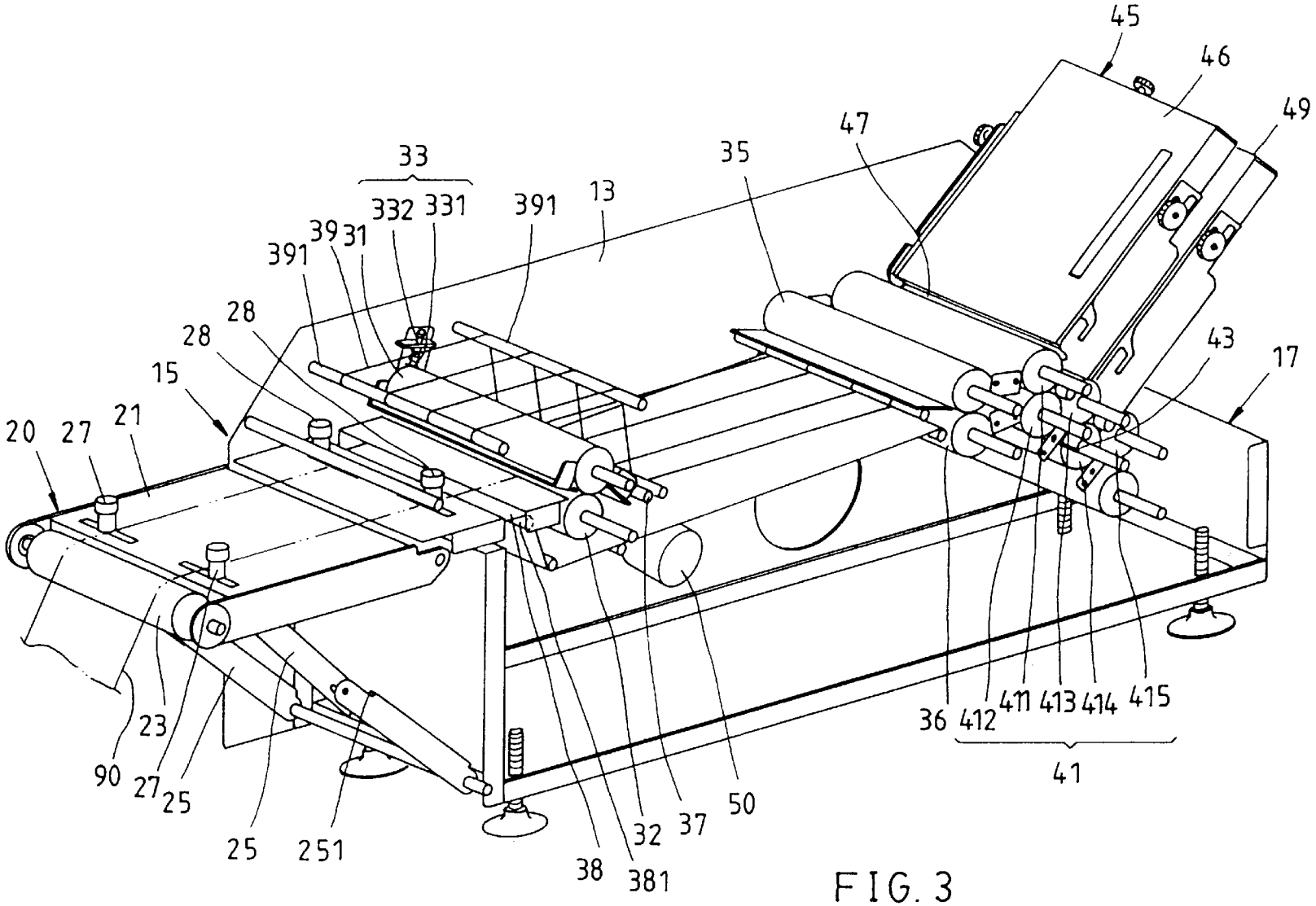
FIG. 3 shows a perspective view of the preferred embodiment of the present invention without the right side support plate.
Figure 4:
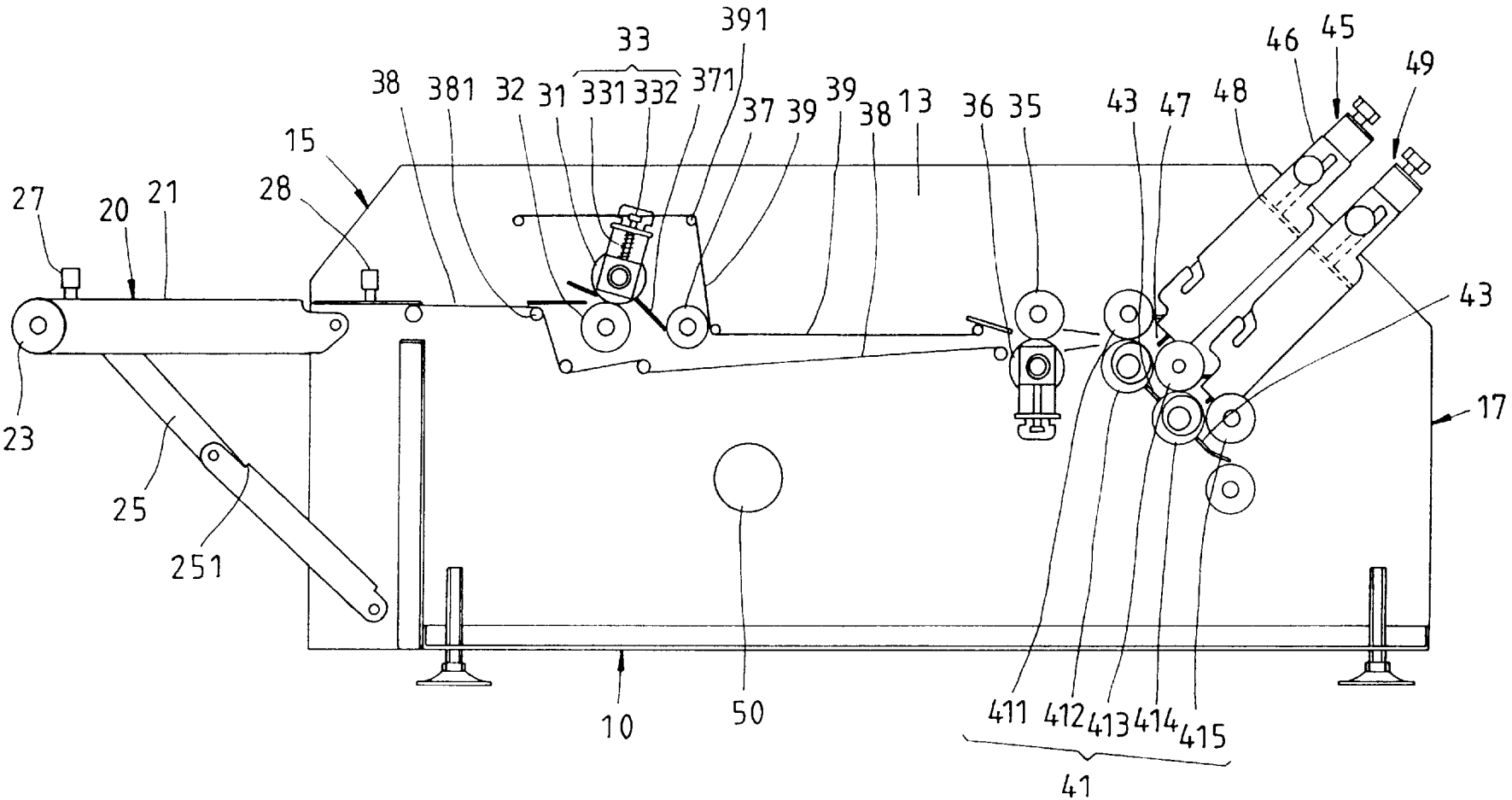
FIG. 4 shows a side view of the present invention as shown in FIG. 3.

In operation, a paper 90 is loaded before the holding plate 21 of the paper guiding set 20 is set at the paper holding position. The crank arms 25 are stretched out straight by the position confining portion 251. One end of the paper 90 is held between the paper feeding rollers 31 and 32 such that the paper 90 is wound on the paper guiding roller 23, as shown in FIG. 3, and that the paper 90 is held by the holding plate 21. As a result, the paper 90 is guided by the paper guiding portions 27 and 28 at a fixed angle at which the paper 90 is fed.

Figure 5:
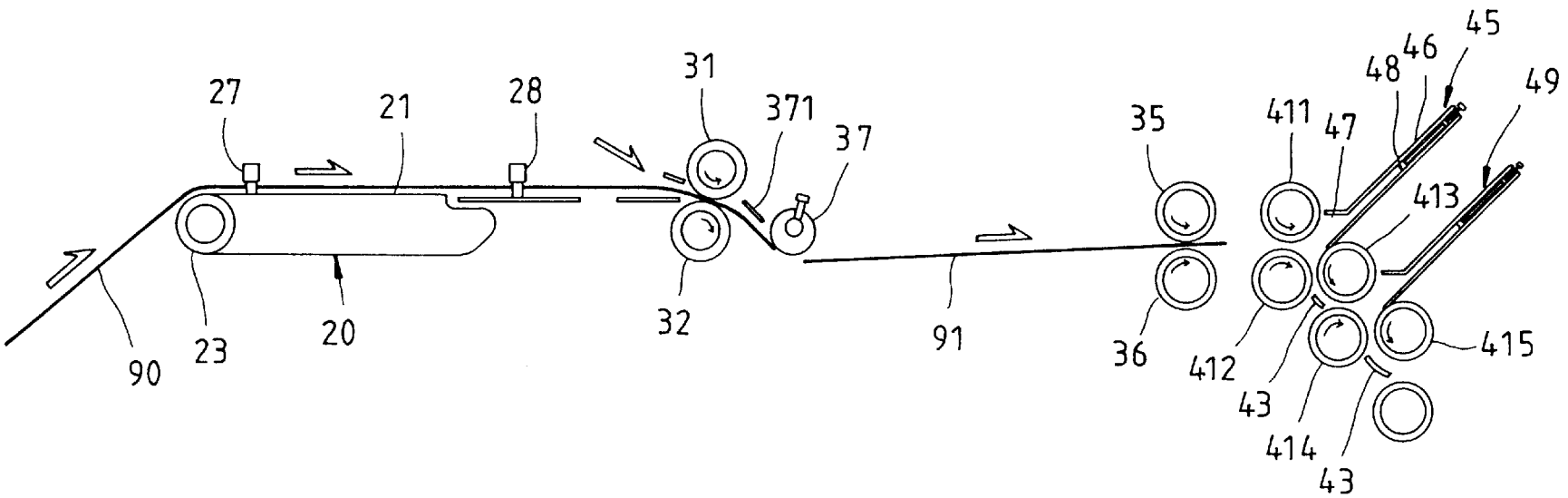
FIG. 5 shows a schematic view of the operational process of the preferred embodiment of the present invention.
Figure 6:
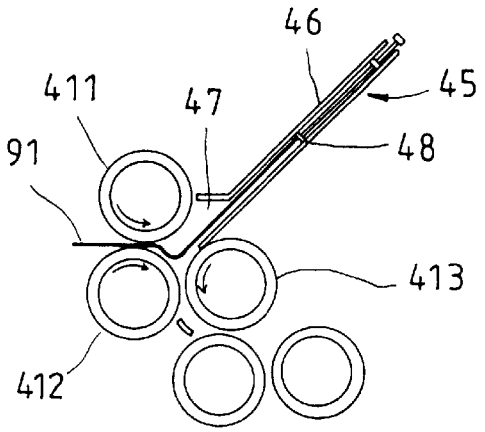
FIG. 6 shows a schematic view of the paper folding member of the present invention at work.
Figure 7:
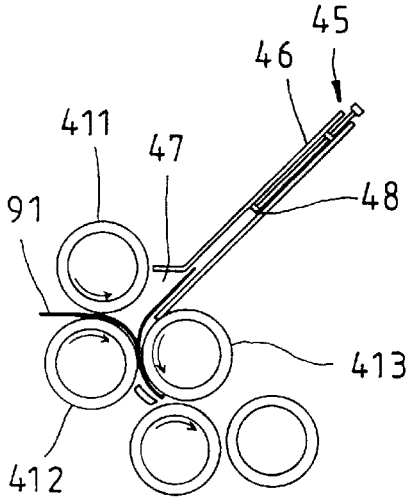
FIG. 7 shows another schematic view of the paper folding member of the present invention at work.

As shown in FIG. 5, the transmission belt 61 is driven by the drive wheel 62 which is in turn driven by the driving unit 50, thereby actuating the paper feeding rollers 31 and 32 to feed the paper 90, which is then guided by the guide plate 371 to pass under the rod body 37 and then between the paper holding portion 38 and the position confining portion 39, as well as between the orienting rollers 35 and 36. As the paper 90 is held between the orienting rollers, the perforation of the paper 90 is located at the rod body 37. In light of the rotational speed of the paper tearing roller being faster than that of the paper feeding rollers, the paper 90 is pulled tight. The tearing roller or rollers may include the orienting rollers 35, 36 and/or the paper-folding rollers 411–415, all of which pull on the paper 90. As a result, the paper 90 is torn off at the perforation of the paper 90. Thereafter, the single paper sheet 91 is held between the first and the second paper folding rollers 411 and 412 such that the paper sheet 91 is also held by the orienting rollers 35 and 36. In light of the orienting rollers 35 and 36 being corresponding in the rotational speed to the paper folding roller 41, the paper sheet 91 is moved in a fixed direction smoothly without being twisted or wrinkled. As the paper sheet 91 is put into the opening 47, the paper sheet 91 is urged by the position confining member 48 such that the paper sheet 91 is bent, as shown in FIG. 6. The paper sheet 91 is further moved through the second and the third rollers 412 and 413, as well as the third and the fourth rollers 413 and 414, before being guided into the second paper confining element 49 to bring about the folding of the paper sheet 91, as shown in FIG. 7. The second folding of the paper sheet 91 is brought about by the fourth and the fifth rollers 414 and 415. The folded paper sheet 91 is discharged via a paper discharging end 17 of the frame 10. In the meantime, the paper 90 is once again fed via the paper feeding end 15 of the frame 10.

The distance between the rod body 37 and the rollers 35 and 36 can be adjusted by an adjusting structure (not shown in the drawing). The distance is dependent on the distance between two perforations of the paper 90.

Figure 8:
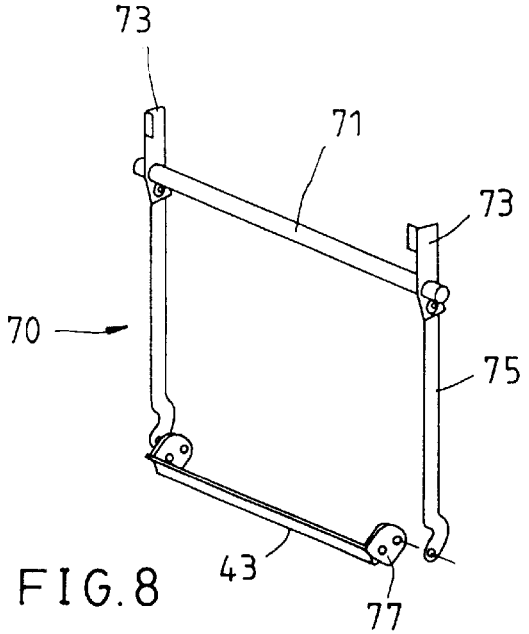
FIG. 8 shows an exploded view of a paper folding switch member.
Figure 9:
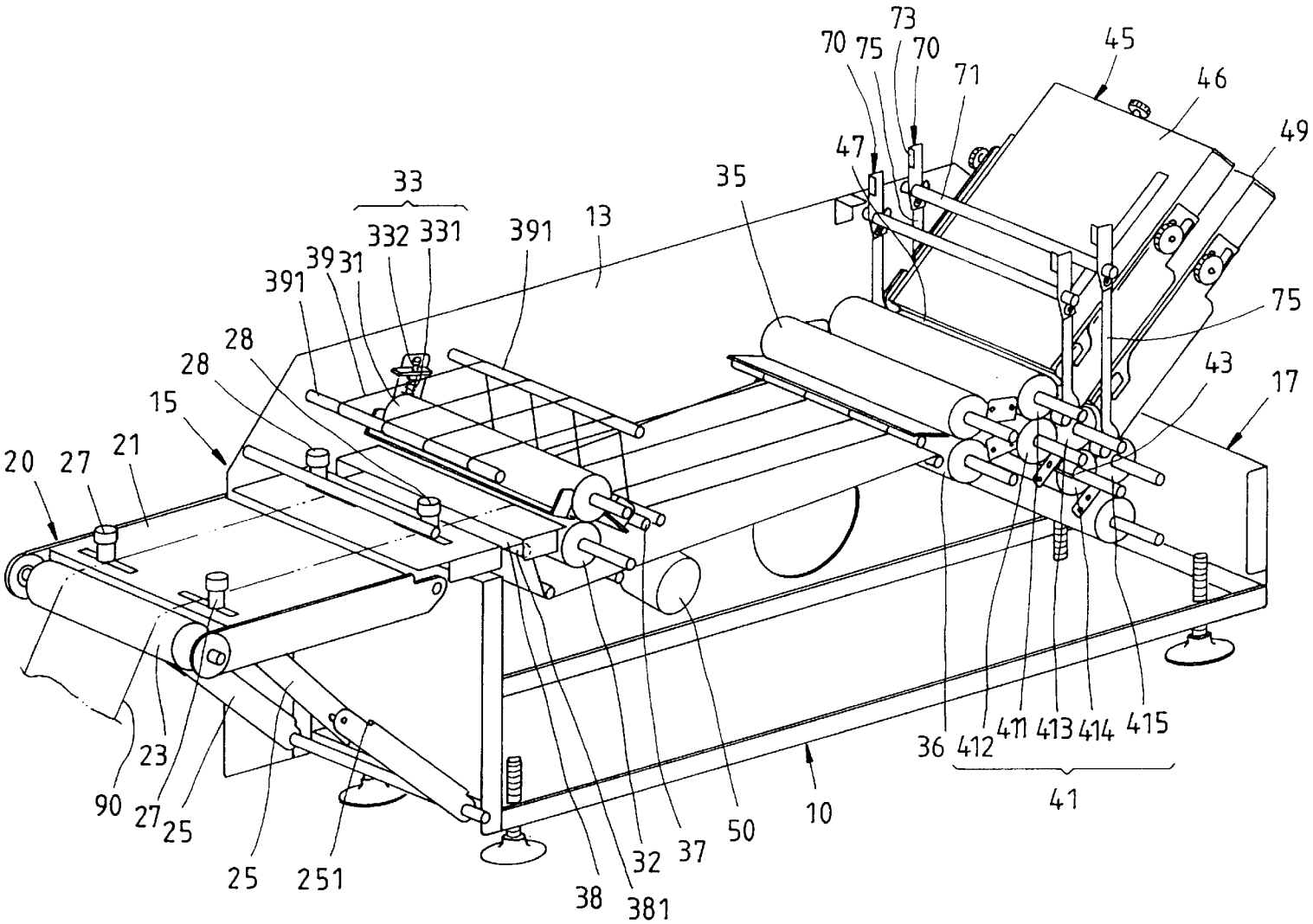
FIG. 9 shows a schematic view of the present invention in conjunction with the paper folding switch member as shown in FIG. 8.
Figure 10:
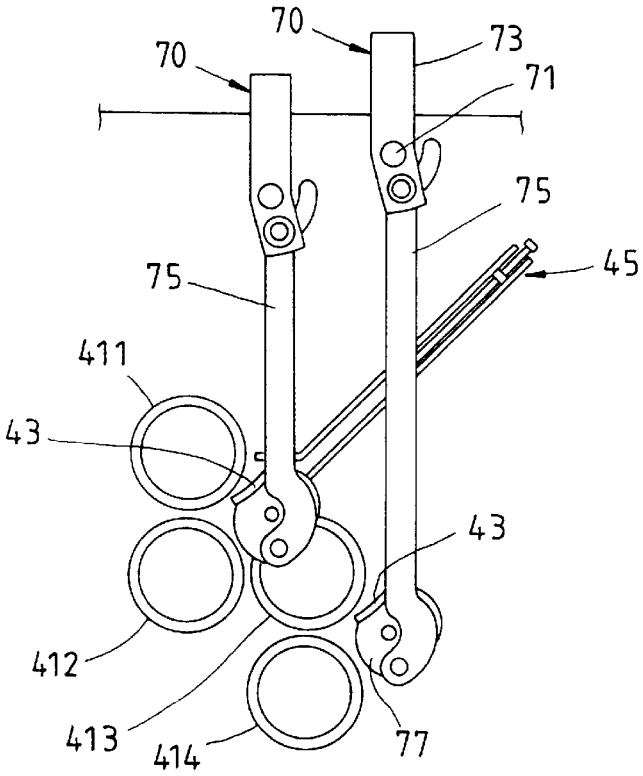
FIG. 10 shows a schematic view of a paper guiding plate of the present invention located at an opening position.
Figure 11:
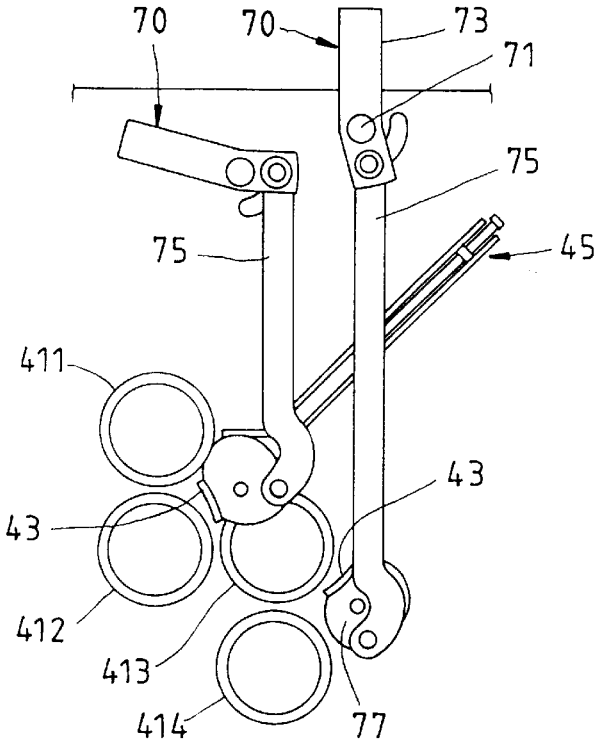
FIG. 11 shows a schematic view of the paper guiding plate of the present invention located at a closing position.

As shown in FIG. 8, the paper folding switch 70 of the present invention is intended to control the folding operation of the present invention. The switch 70 has a shaft 71 which is fastened with support plates 12 and 13, and two moving rods 73 which are fastened pivotally with the shaft 71 such that the moving rods 73 are fastened pivotally at one end thereof with one end of linking rods 75 which are in turn fastened pivotally at other end thereof with deflection members 77. The deflection members 77 are connected with the paper guiding plate 43, as shown in FIG. 9. When the moving rods 73 are actuated, the paper guiding plate 43 is actuated by the deflection members 77 to swivel between an "ON" position 431 and an "OFF" position 432. When the paper guiding plate 43 is located at the "ON" position 431, as shown in FIG. 10, the paper is moved via the first and the second rollers 411 and 412 into the paper confining element 45 such that the paper is folded. When the paper guiding plate 43 is located at the "OFF" position 432, as shown in FIG. 11, the paper is moved to remain between the second and the third rollers 412 and 413 without being folded. A plurality of switches 70 may be set up in conjunction with a plurality of paper folding rollers 41.

It is therefore readily apparent that the present invention is capable of carrying out automatically and continuously the speedy operations of tearing off paper and folding the detached paper, and that the present invention is therefore efficient and cost-effective. In addition, the present invention is simple in construction and can be therefore made at a low cost. Moreover, the present invention is compatible with papers various in thickness, thanks to the rollers which are adjustably pressed against one another.

What is claimed is:

1. A device for tearing off a series of paper sheets from paper having perforations and folding the detached paper sheets, said device comprising:

a frame having a paper feeding end and a detached paper sheet discharging end;

at least two paper feeding rollers fastened pivotally with said frame such that said two paper feeding rollers are located at said paper feeding end, and that said two paper feeding rollers are pressed against each other;

at least three paper folding rollers fastened pivotally with said frame such that a first paper folding roller and a second paper folding roller are pressed against each other, and that said second paper folding roller and a third paper folding roller are pressed against each other, and further that said paper folding rollers are located behind said paper feeding rollers;

a plurality of paper guiding plates fastened with said frame and located between said paper folding rollers;

at least one paper confining element fastened with said frame such that said paper confining element is corresponding in location to said paper folding rollers for bending the detached paper sheet to facilitate the folding of the detached paper sheet by said paper folding rollers;

a linking member comprising a transmission belt, a paper feeding wheel engaged with said transmission belt such that said paper feeding wheel is connected with one of the paper feeding rollers, said linking member further comprising at least one paper folding wheel engaged with said transmission belt and connected with one of the paper folding rollers, said paper feeding wheel being greater in diameter than said paper folding wheel, said paper feeding roller being slower in rotational speed than said paper folding roller, whereby the paper folding rollers are faster than the paper feeding rollers and the sheets are detached from the paper at the perforations; and a driving unit mounted in said frame for driving said transmission belt.

2. The device as defined in claim 1 further comprising a rod body fastened with said frame such that said rod body is corresponding in location to a position which is located between said paper feeding roller and said paper folding roller, and that said rod body is separated from said paper folding roller by a distance which is equal to a length of a paper sheet of the perforated paper sheets.

3. The device as defined in claim 1 further comprising at least two elastic elements fastened between said second paper folding roller and said frame for providing said second paper folding roller with an elastic force enabling said second paper folding roller to press against said first paper folding roller and said third paper folding roller.

4. The device as defined in claim 1 further comprising two orienting rollers fastened between said paper folding rollers and said paper feeding rollers, and pressed against each other, with one end of one of said orienting rollers being fastened with an orienting wheel which is engaged with said transmission belt for actuating said orienting rollers, said orienting wheel being corresponding in diameter and rotational speed to those wheels which are connected with said paper folding rollers.

5. The device as defined in claim 1 further comprising a paper guiding member fastened at said paper feeding end of said frame and comprising a paper holding member fastened pivotally at said paper feeding end of said frame such that said paper holding member swivels between a paper holding position and a paper folding position, said paper guiding member further comprising a paper guiding roller pivotally fastened with said paper holding member, and at least one crank arm fastened with said frame and said paper holding member such that said crank arm is bendable and stretchable out straight so as to keep said paper holding member at said paper holding position or said paper folding position, said paper guiding member still further comprising at least two paper guiding portions fastened adjustably with said paper holding member for guiding paper to remain at an entry angle.

6. The device as defined in claim 1 further comprising a paper folding switch which is comprising a shaft fastened with said frame, two moving rods fastened pivotally with said shaft and two link rods which are in turn fastened pivotally with two deflection members which are fastened with two ends of a paper guiding plate.

7. The device as defined in claim 1, wherein said wheels are respectively fastened with the same end of each of said rollers.

8. The device as defined in claim 1, wherein said driving unit includes a drive wheel to drive said transmission belt.

* * * * *